US006599008B2

(12) United States Patent
Heusser et al.

(10) Patent No.: US 6,599,008 B2
(45) Date of Patent: Jul. 29, 2003

(54) STATIC MIXER

(75) Inventors: Rolf Heusser, Winterthur (CH); Markus Fleischli, Winterthur (CH)

(73) Assignee: Sulzer Chemtech AG, Winterthur (CH)

( * ) Notice: Subject to any disclaimer, the term of this patent is extended or adjusted under 35 U.S.C. 154(b) by 0 days.

(21) Appl. No.: 09/771,490

(22) Filed: Jan. 25, 2001

(65) Prior Publication Data

US 2001/0015936 A1 Aug. 23, 2001

(30) Foreign Application Priority Data

Feb. 17, 2000 (EP) ..... 00810133

(51) Int. Cl.[7] ..... B01F 5/06
(52) U.S. Cl. ..... 366/337
(58) Field of Search ..... 366/181.5, 336, 366/337, 340; 138/37, 39, 40, 42; 48/189.4; 222/145.6

(56) References Cited

U.S. PATENT DOCUMENTS

| | | | | |
|---|---|---|---|---|
| 3,051,453 | A | * | 8/1962 | Sluijters |
| 3,195,865 | A | * | 7/1965 | Harder |
| 3,239,197 | A | | 3/1966 | Tollar |
| 3,328,003 | A | * | 6/1967 | Chisholm |
| 3,406,947 | A | * | 10/1968 | Harder |
| 3,620,506 | A | * | 11/1971 | So |
| 3,893,654 | A | | 7/1975 | Mirua et al. |
| 3,928,199 | A | * | 12/1975 | Kirk et al. |
| 4,040,256 | A | * | 8/1977 | Bosche et al. |
| 4,632,568 | A | | 12/1986 | Emele et al. |
| 4,995,540 | A | * | 2/1991 | Colin et al. |
| 5,033,650 | A | * | 7/1991 | Colin et al. |
| 5,688,047 | A | * | 11/1997 | Signer |
| 5,851,067 | A | * | 12/1998 | Fleischli et al. |
| 5,944,419 | A | | 8/1999 | Streiff |

FOREIGN PATENT DOCUMENTS

| | | |
|---|---|---|
| DE | 2343352 | 3/1975 |
| FR | 1.265.659 | 10/1961 |

* cited by examiner

*Primary Examiner*—Charles E. Cooley
(74) *Attorney, Agent, or Firm*—Townsend and Townsend and Crew LLP

(57) ABSTRACT

A static mixer includes a plurality of mixing chambers for mixing at least two flowable components. The mixing chambers are arranged one behind the other as well as adjacently in a tube along a tube axis. The mixer includes basic mixing chambers and modified mixing chambers. Basic mixing chambers are bounded off from one another by radial walls oriented in the direction of the tube axis and by end walls transverse to the tube axis. Apertures in the radial walls form inputs and outputs between adjacent chambers for the components to be mixed. Modified mixing chambers have structural modifications relative to the basic mixing chambers. In one embodiment, the modification includes adding inclined walls. In another embodiment, the modification includes changing the longitudinal dimension of the chamber relative to the basic mixing chamber.

32 Claims, 3 Drawing Sheets

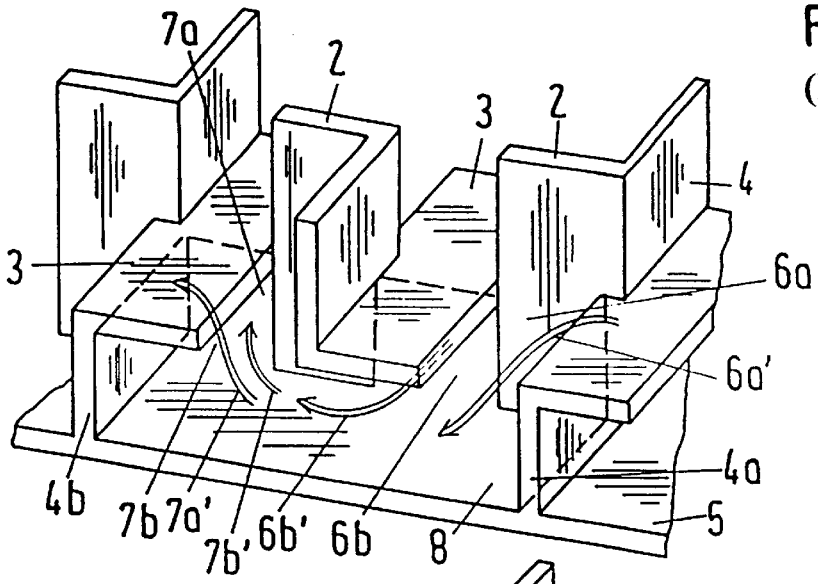
Fig.6
(Prior Art)
Fig.7
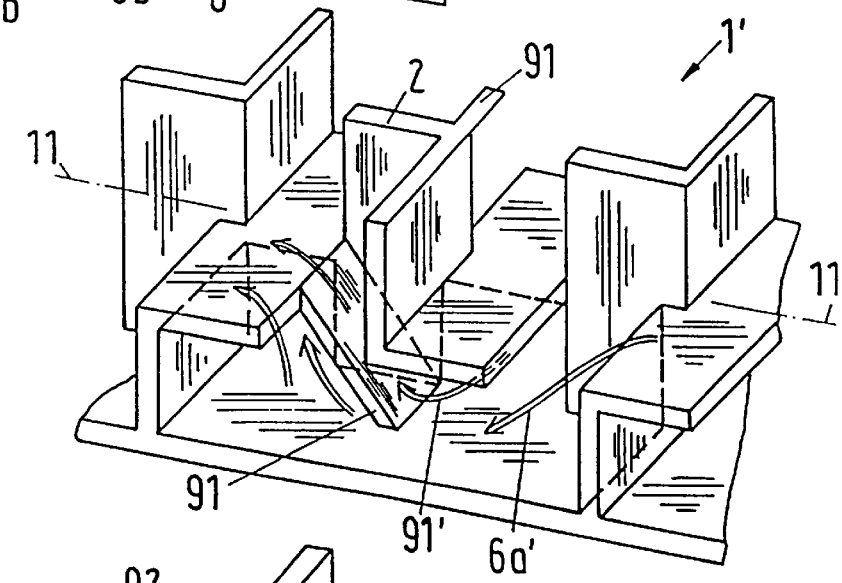
Fig.8
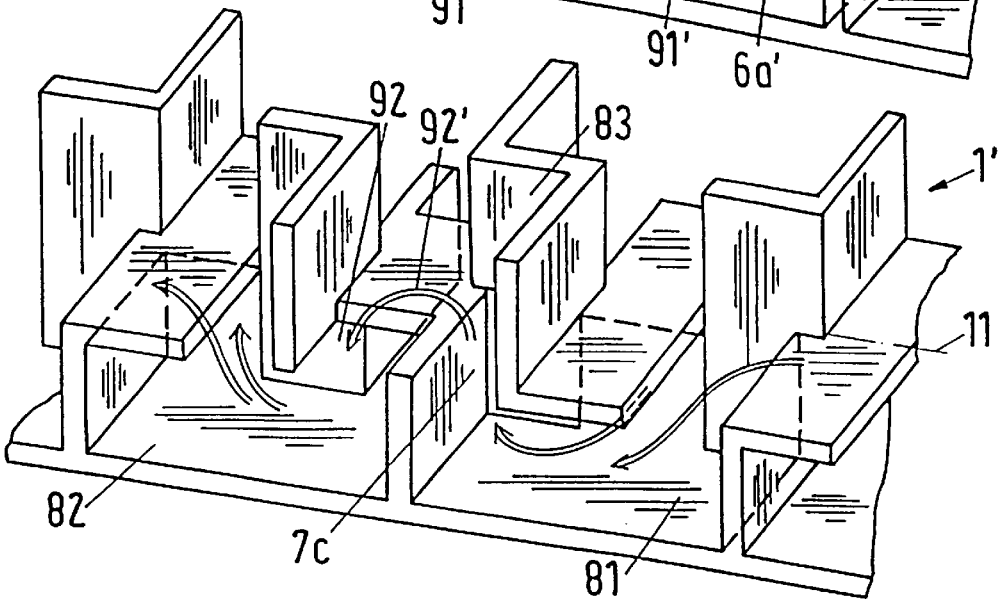

STATIC MIXER

BACKGROUND OF THE INVENTION

The invention relates to a static mixer, to an apparatus comprising a mixer of this kind and to a use of the mixer.

Static mixers for mixing at least two flowable components which are compact and which in spite of a simple, material-saving construction of their mixer structure yield good mixing results are described in EP-A-0 749 776 and EP-A-0 815 929. These mixers are suitable for mixing highly viscous substances such as for example sealing masses, two-component foams or two-component adhesive bonders. They can be economically manufactured of thermoplastics through injection molding so that they can be economically applied for a throw-away use. A "throw-away mixer" of this kind is mainly used for products which harden, since for these products the mixer cannot practically be cleaned.

The mixing results of the referenced mixers are insufficient in certain applications, in particular in cases in which components are mixed which have different viscosity values. An insufficient mixing result becomes evident in that at least one flow filament which consists of only one of the components to be mixed passes through the mixer structure and in so doing experiences practically no or too slow a mixing with adjacent flow filaments. A flow filament of this kind is designated here as "mix-resistant". Mix-resistant flow filaments arise above all in static mixers in which the mixer structure consists of a periodic succession of similar elementary mixing chambers. But mix-resistant flow filaments can also be observed in non-periodic mixer structures.

SUMMARY OF THE INVENTION

It is an object of the invention to create a static mixer of which the mixing result is improved in comparison with the known mixers. This object is satisfied by the static mixer which is described herein.

The static mixer comprises a plurality of mixing chambers which form a mixer structure. The mixing chambers are arranged one behind the other as well as adjacently in a tube along a tube axis. They can be used for mixing at least two flowable components. The mixer structure represents a modification of a basic structure. In said basic structure the mixing chambers are separated from one another by radial walls which are oriented in the direction of the tube axis and by walls which are transverse to the tube axis. Apertures between adjacent chambers in the radial walls form inputs and outputs for the components to be mixed. The modification consists of structure changes at individual locations of the basic structure. It is carried out in such a manner that a transverse dislocation of mix-resistant flow filaments results in the flowing components being mixed, with these flow filaments being mix-resistant with respect to the basic structure.

Through the transverse dislocation of the mix-resistant flow filament the latter enters into a region in which it is subject to a strong deformation and thereby becomes more miscible. The dislocated flow filament is replaced by another one which is now in turn largely decoupled from the mixing process. It is therefore advantageous if such disturbance locations, which cause a dislocation of the respective mix-resistant flow filament, are set up at a plurality of positions of the static mixer. It is also advantageous if the disturbance locations are formed differently.

The disturbance locations as a rule have a disadvantageous effect on the mixing process in flow regions which lie outside the mix-resistant flow filament. If this is the case, then only as many disturbance locations should be provided as are necessary for a sufficient number of dislocations of the mix-resistant flow filaments.

The disturbance locations can be formed such that they do not act directly on the mix-resistant flow filament, but rather indirectly in that they cause deflections in their direct region of influence which then in turn influence the mix-resistant flow filament. A design of suitable disturbance locations can be found empirically. Experiments with components which are to be mixed and which are differently colored are carried out and the results for a basic structure are compared with those of a modification of the basic structure, with it being possible to determine whether mix-resistant flow filaments have actually been dislocated.

The following sections describe advantageous embodiments of the static mixer in accordance with the invention, apparatuses with mixers of this kind, and a use thereof.

BRIEF DESCRIPTION OF THE DRAWINGS

In the following the invention will be explained with reference to the drawings, in which:

FIG. 6 is an oblique perspective view pertaining to the basic structure of FIG. 1, FIG. 7 is an oblique perspective view of the basic structure with the first modification in accordance with FIG. 4, FIG. 8 is an oblique perspective view of the basic structure with the second modification in accordance with FIG. 5.

DESCRIPTION OF THE PREFERRED EMBODIMENTS

Figure 1:
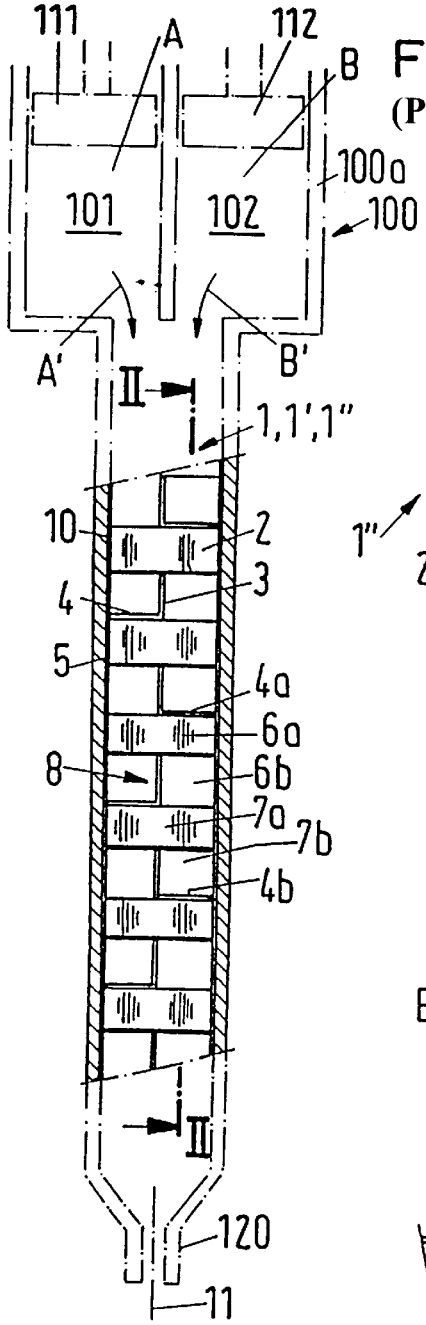
Fig.1 (Prior Art)
FIG. 1 is a side view of a static mixer with a regular, non-modified mixer structure which represents a basic structure.

In FIG. 1 an apparatus 100 is indicated in chain-dotted lines. The apparatus contains a static mixer 1, the mixer structure 1' of which forms a regular, non-modified basic structure 1". The mixer structure 1' is illustrated as a side view. It is known from the named EP-A-0 749 776 and EP-A-0 815 929 in which the basic structure 1" is described in two different ways. The basic structure 1" is composed of a plurality of mixing elements which are arranged one behind the other in a tube 10; or it consists of a bundle of four chambered strings, the mixing chambers 8 ("mix-active chambers") of which in each case extend between two closed ends 4*a* and 4*b*. Each of the mixing elements comprises two axial sections, with at least one partitioning web 2 and 3 respectively (radial walls) which subdivides the section being associated with each of the sections. The partitioning webs 2, 3 cross one another and subdivide the tube cross-section into equally large sub-areas. The sub-areas are open or covered over by deflection discs 4. One recognizes further details in the drawings, in particular in FIG. 6, which illustrates a non-modified basic structure 1" with a completely shown mixing chamber 8.

The mixing chambers 8 of the basic structure 1" are without internal installations, are equally large and are arranged with displacement with respect to one another. Two inputs 6*a*, 6*b* and two outputs 7*a*, 7*b* arranged in an alternating sequence form connections to four adjacent chambers, with material flowing between chambers as shown by arrows 6*a*', 6*b*', 7*a*', 7*b*'. Two lateral reinforcement walls 5 extend over the entire length of the mixer 1.

The apparatus 100 includes a two-chambered container 100*a*, namely a cartridge, with chambers 101 and 102. The latter serve for the separate reception of two flowable components A and B. A and B can be pressed in into the tube 10 (arrows A', B) through outputs of the container 100*a* by means of pistons 111 and 112. After a mixing of A with B in the static mixer 1, which is composed of the tube 10 and the mixer structure 1', the mixture emerges from the apparatus 100 through a nozzle 120. The cartridge 100*a* can comprise more than two chambers. The tube 10 can be formed as a tube part which can be placed on onto the cartridge 100*a*.

Figure 2:
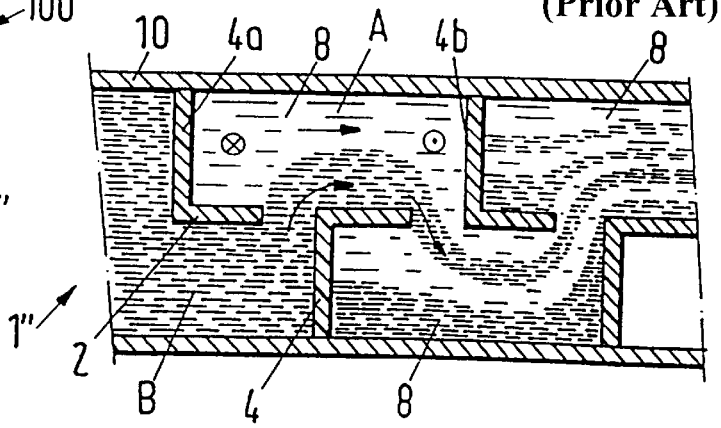
Fig.2 (Prior Art)
FIG. 2 is an illustration of the mixing process, drawn in accordance with results of a numerical simulation.

A section in accordance with the line II—II is illustrated in FIG. 2. The two components A and B, which have the same values for the viscosity, flow through the mixer structure 1'. Arrows in the mixing chamber 8 indicate the path of the flow (with the symbols 'circle with cross' and 'circle with dot' meaning downward and upward arrows respectively with respect to the plane of the drawing). The flow pattern is drawn in accordance with results of a numerical simulation. As one sees, the flow filaments appear as layers of similar thickness; this represents good mixing.

Figure 3:
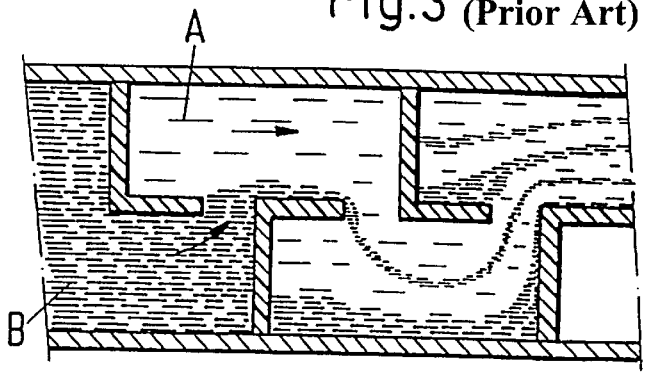
Fig.3 (Prior Art)
FIG. 3 is an illustration corresponding to that in FIG. 2 for a mixing of two components, the viscosity values of which are substantially different.

FIG. 3 shows an illustration corresponding to that of FIG. 2, for two components A and B, the viscosity values of which differ by a factor of 100. The less viscous component B forms much narrower layers, since this component flows faster. The flow filaments propagate irregularly. A further irregularity is particularly strongly developed over a cross-section which is perpendicular to the illustrated section. These irregularities result in poor mixing.

Figure 4:
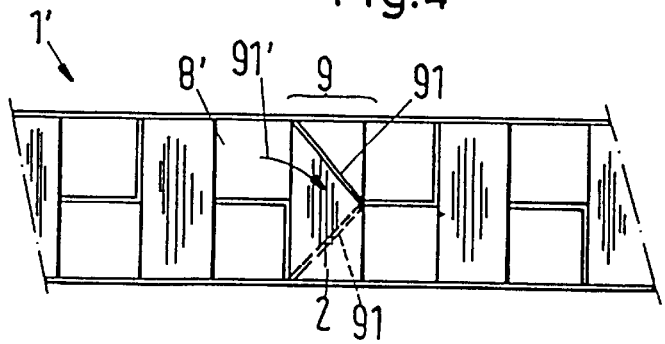
FIG. 4 is a side view of a first modification of the basic structure which is illustrated in FIG. 1.

As a result of the drawbacks that the mixing process displays, mix-resistant flow filaments result, which is visible in the mixed product, against the unfavorable influence of which the measures in accordance with the invention are directed. These measures, in the form of a modification of the basic structure, have been successful; two successful cases with in each case one modification 9 are illustrated in FIGS. 4 and 7 and, respectively, FIGS. 5 and 8. The mixer structures which are illustrated in FIGS. 6 to 8 are illustrated with only one reinforcement wall 5 for the better recognizability of the essential features.

The modification 9 in accordance with FIGS. 4 and 7 is formed by an inclined web 91 in the mixing chamber 8' which is inclined with respect to the tube axis 11 or axis of the mixer structure 1'. The web 91 connects on a radial wall 2 an input 6*b* to an output 7*a* in such a manner that the flow is deflected by the web 91 from the tube wall 10 in the direction towards tube axis 11 (arrow 91'). The reverse is also possible: a flow deflection by the web 91 from the tube axis 11 in the direction towards the tube wall 10.

Figure 5:
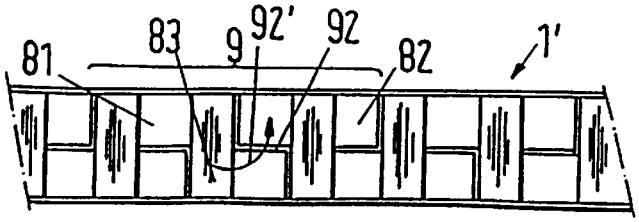
FIG. 5 is a side view of a second modification.

The modification 9 in accordance with FIGS. 5 and 8 is formed by shortenings of the lengths of three adjacent chambers 81, 82 and 83 with a simultaneous lowering of the number of inputs or outputs. In this embodiment the pair of chambers 81 and 82, which lie one behind the other along the tube axis 11, is arranged laterally to the third chamber 83. Two apertures 7*c* and 92 produce a connection (arrow 92') between the two chambers of the pair 81, 82.

A modification 9 advantageously comprises a plurality of disturbance locations with modification elements 91 (first modification) or 81, 82, 83, 92 (second modification) respectively, which are preferably positioned regularly over the entire length of the static mixer 1. A non-illustrated combination of the two modification elements 91 and 81, 82, 83, 92 respectively is particularly advantageous.

Figure 9:
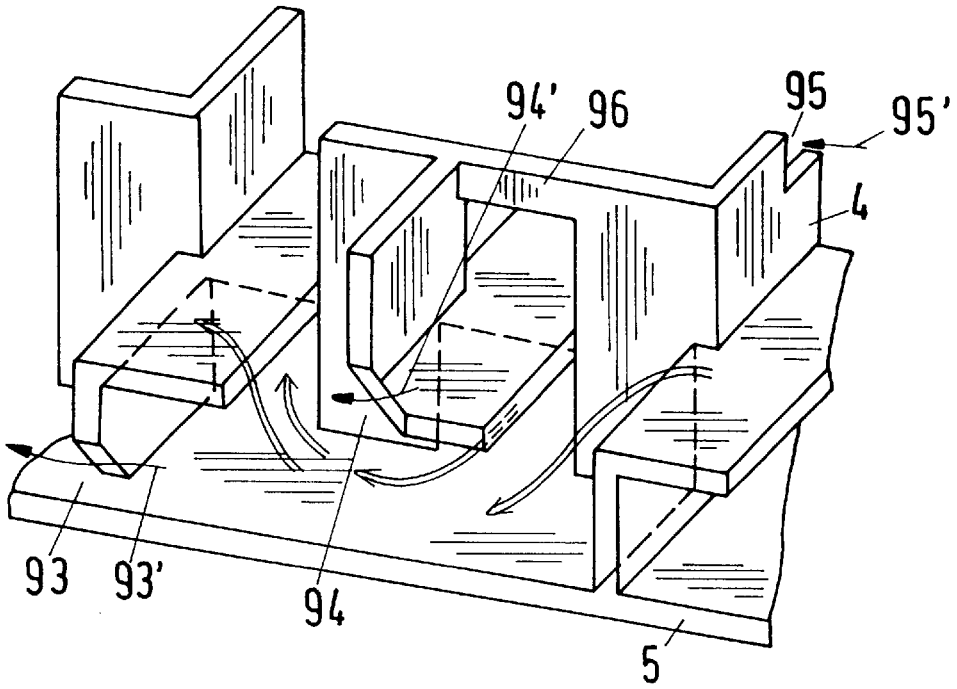
FIG. 9 is an oblique perspective view showing further examples of modifications.

Further possibilities of modifying the basic structure are illustrated in summary in FIG. 9: a) broken-out wall pieces 93, 94 and 95 which cause bypass flows (arrows 93', 94' and 95'); and b) added webs 96 which narrow the passages between mixing chambers 8.

Figure 10:
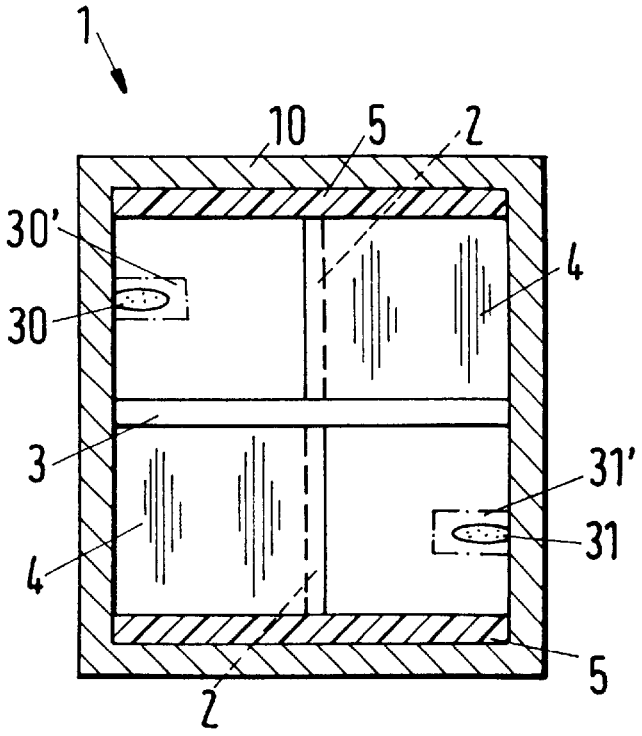
FIG. 10 is an illustration of the arising of mix-resistant flow filaments.

Finally, FIG. 10 schematically shows mix-resistant flow filaments 30 and 31 with reference to a cross-section through the static mixer 1. The contours of these flow filaments are less clear than illustrated; they are toothed diffusely and are located in a further surrounding 30' and 31' respectively.

The mixer structures 11' of the described embodiments are advantageously formed monolithically; they can in particular be injection molded from a thermoplastic. The mixer structure 11' has a rectangular cross-section and comprises four adjacently arranged chamber strings. Each string forms a series of from 5 to 15 mixing chambers 8. Each chamber 8 of the basic structure has a length which is 1.5 to 2.5 times as long as a chamber width, with this width being greater than 1 mm and less than 10 mm, preferably at least 2 mm and a maximum of 5 mm.

The apparatus 100 is suitable for mixing a highly viscous component A with at least one further component B which can have a viscosity which is lower by a factor of 10 to 1000. The mass flow of the further component can be smaller than the mass flow of the highly viscous component by a multiple, for example by a factor of 10.

What is claimed is:

1. A static mixer for mixing at least two flowable components, comprising:

a mixing tube; and a plurality of mixing chambers disposed within the mixing tube so as to form a plurality of interconnected chamber strings arranged around an axis of the mixing tube, the plurality of mixing chambers including a plurality of basic mixing chambers and a first modified mixing chamber, each of the basic mixing chambers having a basic structure including at least two side walls oriented substantially parallel to the axis of the mixing tube and at least two end walls oriented substantially transverse to the axis of the mixing tube, each of the at least two side walls having at least one aperture therein, thereby providing passages connecting mixing chambers in different ones of the plurality of chamber strings, the first modified mixing chamber having a modified structure including an inclined web of material oriented so as to deflect a flowable material either toward or away from the axis of the mixing tube.

2. The static mixer according to claim 1, wherein the plurality of mixing chambers further includes a second modified mixing chamber, the second modified mixing chamber having a structure different from the basic structure, wherein the first modified mixing chamber is disposed at a first disturbance location along the axis of the mixing tube and the second modified mixing chamber is disposed at a second disturbance location along the axis of the mixing tube.

3. The static mixer according to claim 2, wherein the second modified mixing chamber includes an inclined web of material oriented so as to deflect a flowable material either toward or away from the axis of the mixing tube.

4. The static mixer according to claim 2, wherein the second modified mixing chamber has a shorter length than each basic mixing chamber and fewer passages than each basic mixing chamber.

5. The static mixer according to claim 2, wherein the second modified mixing chamber has a web of material disposed so as to partially obstruct at least one passage of the second modified mixing chamber.

6. The static mixer according to claim 2, wherein the second modified mixing chamber has a portion of an end wall removed, thereby creating a passage in the end wall.

7. The static mixer according to claim 1, further comprising:

at least two holding chambers, each holding chamber adapted to receive a flowable material and having an outlet coupled to an inlet of the mixing tube.

8. The static mixer according to claim 7, further comprising:

a piston member insertable into each of the at least two holding chambers, wherein compressing the piston member causes a flowable material in each holding chamber to flow through the outlet of the respective holding chamber.

9. The static mixer according to claim 1, wherein the plurality of mixing chambers is in the form of a monolithic structure.

10. The static mixer according to claim 9, wherein the monolithic structure comprises a thermoplastic.

11. The static mixer according to claim 9, wherein the plurality of mixing chambers is formed by injection molding.

12. The static mixer according to claim 1, wherein each basic mixing chamber has two side walls, each side wall having two apertures therein disposed so as to connect the basic mixing chamber to four other mixing chambers.

13. The static mixer according to claim 1, wherein the mixing chambers have a square or rectangular cross-section and are disposed so as to form four adjacent chamber strings.

14. The static mixer according to claim 13, wherein each chamber string includes between five and fifteen mixing chambers.

15. The static mixer according to claim 1, wherein the plurality of mixing chambers is adapted for mixing a first component having a first viscosity with at least a second component having a second viscosity, wherein the first viscosity is greater than the second viscosity by a factor of between 10 and 1000.

16. The static mixer according to claim 1, wherein the mixing chambers have a square or rectangular cross-section and are disposed so as to form four adjacent chamber strings.

17. The static mixer according to claim 16, wherein each chamber string includes between five and fifteen mixing chambers.

18. The static mixer according to claim 16, wherein each basic mixing chamber has a length and a width, the length being between 1.5 times the width and 2.5 times the width.

19. The static mixer according to claim 18, wherein the width is between about 1 mm and about 10 mm.

20. A static mixer for mixing at least two flowable components, comprising:

a mixing tube; and a plurality of mixing chambers disposed within the mixing tube so as to form a plurality of interconnected chamber strings arranged around an axis of the mixing tube, the plurality of mixing chambers including a plurality of basic mixing chambers and at least three modified mixing chambers, each basic mixing chamber having a basic structure including at least two side walls oriented substantially parallel to the axis of the mixing tube and at least two end walls oriented substantially transverse to the axis of the mixing tube, each of the side walls having at least one aperture therein, thereby providing passages connecting mixing chambers in different ones of the plurality of chamber strings, each basic mixing chamber having substantially the same length between end walls, the modified mixing chambers including a group of three connected chambers each having a shorter length between end walls than each basic mixing chamber and fewer apertures in the side walls than each basic mixing chamber, wherein a first chamber and a second chamber of the group are disposed in a first one of the plurality of chamber strings with the second chamber directly behind the first chamber and a third chamber of the group is disposed in a second one of the plurality of chamber strings with its passages oriented so as to connect the first chamber to the second chamber.

21. The static mixer according to claim 20, wherein the plurality of mixing chambers further includes a fourth modified mixing chamber, the fourth modified mixing chamber having a structure different from the basic structure, wherein the group of three connected chambers are located at a first disturbance location along the axis of the mixing tube and the fourth modified mixing chamber is located at a second disturbance location along the axis of the mixing tube.

22. The static mixer according to claim 21, wherein the fourth modified mixing chamber includes an inclined web of material oriented so as to deflect a flowable material either toward or away from the axis of the mixing tube.

23. The static mixer according to claim 21, wherein the fourth modified mixing chamber has a shorter length than each basic mixing chamber and fewer passages than each basic mixing chamber.

24. The static mixer according to claim 21, wherein the fourth modified mixing chamber has a web of material disposed so as to partially obstruct at least one passage of the fourth modified mixing chamber.

25. The static mixer according to claim 21, wherein the fourth modified mixing chamber has a portion of an end wall removed, thereby creating a passage in the end wall.

26. The static mixer according to claim 20, further comprising:

at least two holding chambers, each holding chamber adapted to receive a flowable material, each holding chamber having an outlet coupled to an inlet of the mixing tube.

27. The static mixer according to claim 26, further comprising:

a piston member insertable into each of the at least two holding chambers, wherein compressing the piston member causes a flowable material in each holding chamber to flow through the outlet of the respective holding chamber.

28. The static mixer according to claim 26, wherein the plurality of mixing chambers is in the form of a monolithic structure.

29. The static mixer according to claim 28, wherein the monolithic structure comprises a thermoplastic.

30. The static mixer according to claim 20, wherein the plurality of mixing chambers is formed by injection molding.

31. The static mixer according to claim 20, Wherein each basic mixing chamber has two side walls, each side wall having two apertures therein disposed so as to connect the basic mixing chamber to four other mixing chambers.

32. The static mixer according to claim 20, wherein the plurality of mixing chambers is adapted for mixing a first component having a first viscosity with at least a second component having a second viscosity, wherein the first viscosity is greater than the second viscosity by a factor of between 10 and 1000.

* * * * *